US007200955B2

(12) United States Patent
Foxen

(10) Patent No.: US 7,200,955 B2
(45) Date of Patent: Apr. 10, 2007

(54) ARTICLE OF FOOTWEAR INCORPORATING A SOLE STRUCTURE WITH COMPRESSIBLE INSERTS

(75) Inventor: Thomas Foxen, Portland, OR (US)

(73) Assignee: Nike, Inc., Beaverton, OR (US)

( * ) Notice: Subject to any disclaimer, the term of this patent is extended or adjusted under 35 U.S.C. 154(b) by 537 days.

(21) Appl. No.: 10/862,055

(22) Filed: Jun. 4, 2004

(65) Prior Publication Data

US 2005/0268490 A1 Dec. 8, 2005

(51) Int. Cl.
*A43B 13/16* (2006.01)

(52) U.S. Cl. ..... 36/25 R; 36/28; 36/35 R; 36/30 R; 36/31

(58) Field of Classification Search ..... 36/28, 36/29, 25 R, 30 R, 31, 35 R
See application file for complete search history.

(56) References Cited

U.S. PATENT DOCUMENTS 1,219,507 A 3/1917 Teare
1,602,675 A 10/1926 Hurley
3,021,846 A 2/1962 Scholl
3,253,355 A * 5/1966 Menken ..... 36/29
3,373,510 A 3/1968 Mernole et al.
3,538,628 A 11/1970 Einstein, Jr.
3,846,919 A 11/1974 Milotic
4,003,146 A 1/1977 Meier et al.
4,124,946 A 11/1978 Tomlin
4,128,951 A 12/1978 Tansill
4,180,924 A 1/1980 Subotnick
4,183,156 A 1/1980 Rudy
4,219,945 A 9/1980 Rudy
4,255,877 A 3/1981 Bowerman
4,287,675 A 9/1981 Norton et al.
4,297,797 A 11/1981 Meyers
4,316,335 A * 2/1982 Giese et al. ..... 36/129
4,354,318 A 10/1982 Frederick et al.
4,364,188 A 12/1982 Turner et al.
4,364,189 A 12/1982 Bates (Continued)

FOREIGN PATENT DOCUMENTS

BE 493654 6/1950

(Continued)

OTHER PUBLICATIONS

Partial International Search Report in corresponding PCT application, International Application No. PCT/US2005/019895, mailed Oct. 24, 2005.

(Continued)

*Primary Examiner*—Marie Patterson
(74) *Attorney, Agent, or Firm*—Banner & Witcoff, Ltd.

(57) ABSTRACT

An article of footwear is disclosed that incorporates an upper and a sole structure secured to the upper. The sole structure includes a midsole and an outsole. The midsole defines an aperture with a first sidewall, and the midsole includes an insert positioned within the aperture. The insert has a second sidewall, with at least a portion of the second sidewall being spaced from the first sidewall to define a space between the first sidewall and the second sidewall. The outsole is secured to the midsole, and the outsole defines a ridge that is positioned within a lower portion of the space and between the first sidewall and the second sidewall.

63 Claims, 8 Drawing Sheets

U.S. PATENT DOCUMENTS

| | | | | | |
|---|---|---|---|---|---|
| 4,420,894 | A | | 12/1983 | Glassman | |
| 4,445,283 | A | | 5/1984 | Meyers | |
| 4,538,368 | A | | 9/1985 | Mugford | |
| 4,597,195 | A | | 7/1986 | Dananberg | |
| 4,627,178 | A | | 12/1986 | Sullivan et al. | |
| 4,689,898 | A | | 9/1987 | Fahey | |
| 4,745,693 | A | | 5/1988 | Brown | |
| 4,756,096 | A | | 7/1988 | Meyer | |
| 4,768,295 | A | * | 9/1988 | Ito | 36/28 |
| 4,813,157 | A | | 3/1989 | Boisvert et al. | |
| 4,823,420 | A | | 4/1989 | Bartneck | |
| 4,825,563 | A | | 5/1989 | Strongwater | |
| 4,850,122 | A | | 7/1989 | Schwab, Jr. | |
| 4,887,369 | A | | 12/1989 | Bailey et al. | |
| 4,906,502 | A | | 3/1990 | Rudy | |
| 4,974,344 | A | | 12/1990 | Ching | |
| 5,036,851 | A | | 8/1991 | Cohen | |
| 5,068,983 | A | | 12/1991 | Marc | |
| 5,083,361 | A | | 1/1992 | Rudy | |
| 5,083,385 | A | | 1/1992 | Halford | |
| 5,247,742 | A | | 9/1993 | Kilgore et al. | |
| 5,282,326 | A | | 2/1994 | Schroer, Jr. et al. | |
| 5,297,349 | A | | 3/1994 | Kilgore | |
| 5,367,791 | A | | 11/1994 | Gross et al. | |
| 5,381,610 | A | | 1/1995 | Hanson | |
| 5,410,821 | A | | 5/1995 | Hilgendorf | |
| 5,493,791 | A | * | 2/1996 | Kramer | 36/28 |
| 5,533,280 | A | | 7/1996 | Halliday | |
| 5,625,964 | A | | 5/1997 | Lyden et al. | |
| 5,661,915 | A | | 9/1997 | Smith | |
| 5,741,568 | A | * | 4/1998 | Rudy | 428/69 |
| 5,775,005 | A | * | 7/1998 | McClelland | 36/31 |
| 5,799,417 | A | | 9/1998 | Burke et al. | |
| 5,815,949 | A | * | 10/1998 | Sessa | 36/3 B |
| 5,822,888 | A | | 10/1998 | Terry | |
| 5,918,383 | A | * | 7/1999 | Chee | 36/28 |
| 5,987,781 | A | * | 11/1999 | Pavesi et al. | 36/29 |
| 5,991,950 | A | | 11/1999 | Schenkel | |
| 5,993,585 | A | | 11/1999 | Goodwin et al. | |
| 6,023,857 | A | | 2/2000 | Vizy et al. | |
| 6,023,859 | A | | 2/2000 | Burke et al. | |
| 6,038,790 | A | * | 3/2000 | Pyle et al. | 36/30 R |
| 6,041,521 | A | | 3/2000 | Wong et al. | |
| 6,082,023 | A | * | 7/2000 | Dalton | 36/28 |
| 6,082,024 | A | * | 7/2000 | Del Biondi | 36/28 |
| 6,092,251 | A | * | 7/2000 | Tomat | 12/142 P |
| 6,119,371 | A | | 9/2000 | Goodwin et al. | |
| 6,120,880 | A | * | 9/2000 | Crow | 428/167 |
| 6,145,221 | A | | 11/2000 | Hockerson | |
| 6,176,025 | B1 | * | 1/2001 | Patterson et al. | 36/28 |
| 6,367,172 | B2 | * | 4/2002 | Hernandez | 36/103 |
| 6,457,261 | B1 | | 10/2002 | Crary | |
| 6,477,792 | B2 | | 11/2002 | Sartor | |
| 2002/0053146 | A1 | | 5/2002 | Swigart et al. | |
| 2003/0208929 | A1 | | 11/2003 | Lucas et al. | |
| 2004/0049947 | A1 | * | 3/2004 | Smith et al. | 36/29 |

FOREIGN PATENT DOCUMENTS

| | | |
|---|---|---|
| DE | 831873 | 1/1952 |
| DE | 3439675 | 10/1984 |
| DE | 3406504 | 8/1985 |
| DE | 201 12 569 | 2/2002 |
| EP | 0 500 247 | 8/1992 |
| FR | 2 813 766 | 3/2002 |
| GB | 425749 | 3/1935 |
| GB | 483028 | 4/1938 |
| WO | WO 91/11931 | 8/1991 |
| WO | WO 97/46127 | 12/1997 |
| WO | WO 00/30483 | 6/2000 |
| WO | WO 2004/014171 | 2/2004 |
| WO | WO 2004/082416 | 9/2004 |

OTHER PUBLICATIONS

International Search Report in corresponding PCT application, International Application No. PCT/US2005/019895, mailed Jan. 2, 2006.

* cited by examiner

ARTICLE OF FOOTWEAR INCORPORATING A SOLE STRUCTURE WITH COMPRESSIBLE INSERTS

BACKGROUND OF THE INVENTION

1. Field of the Invention

The present invention relates to sole structures for articles of footwear. The invention concerns, more particularly, a sole structure for an article of footwear that includes compressible midsole inserts.

2. Description of Background Art

A conventional article of athletic footwear includes two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and the ground. In addition to attenuating ground reaction forces and absorbing energy (i.e., imparting cushioning), the sole structure may provide traction and control foot motions, such as over pronation. Accordingly, the upper and the sole structure operate cooperatively to provide a comfortable structure that is suited for a wide variety of ambulatory activities, such as walking and running.

The sole structure of athletic footwear generally exhibits a layered configuration that includes a comfort-enhancing insole, a resilient midsole formed from a polymer foam, and a ground-contacting outsole that provides both abrasion-resistance and traction. The midsole is the primary sole structure element that imparts cushioning and controls foot motions. Suitable polymer foam materials for the midsole include ethylvinylacetate or polyurethane that compress resiliently under an applied load to attenuate ground reaction forces and absorb energy. Conventional polymer foam materials are resiliently compressible, in part, due to the inclusion of a plurality of open or closed cells that define an inner volume substantially displaced by gas.

The midsole may be formed from a unitary element of polymer foam that extends throughout the length and width of the footwear. With the exception of a thickness differential between the heel and forefoot areas of the footwear, such a midsole exhibits substantially uniform properties in each area of the sole structure. In order to vary the properties of midsole, some conventional midsoles incorporate dual-density polymer foams. More particularly, a lateral side of the midsole may be formed from a first foam material, and the medial side of the midsole may be formed from a second, less compressible foam material. Another means of varying the properties of the midsole involves the use of stability devices that resist pronation. Examples of stability devices include U.S. Pat. No. 4,255,877 to Bowerman; U.S. Pat. No. 4,288,929 to Norton et al.; U.S. Pat. No. 4,354,318 to Frederick et al.; U.S. Pat. No. 4,364,188 to Turner et al.; U.S. Pat. No. 4,364,189 to Bates; and U.S. Pat. No. 5,247,742 to Kilgore et al.

Another manner of varying the properties of the midsole involves the use of fluid-filled bladders. U.S. Pat. No. 4,183,156 to Rudy, discloses an inflatable insert formed of elastomeric materials. The insert includes a plurality of tubular chambers that extend substantially longitudinally throughout the length of the footwear. The chambers are in fluid communication with each other and jointly extend across the width of the footwear. U.S. Pat. No. 4,219,945 to Rudy discloses an inflated insert encapsulated in a polymer foam material. The combination of the insert and the encapsulating polymer foam material functions as a midsole. Examples of additional fluid-filled bladders for footwear include U.S. Pat. Nos. 4,906,502 and 5,083,361, both to Rudy and U.S. Pat. Nos. 5,993,585 and 6,119,371, both to Goodwin et al.

SUMMARY OF THE INVENTION

The present invention is an article of footwear incorporating an upper and a sole structure secured to the upper. The sole structure includes a midsole and an outsole. The midsole extends along at least a portion of a longitudinal length of the footwear, and the midsole defines an aperture with a first sidewall. The midsole includes an insert positioned within the aperture. The insert has a second sidewall, with at least a portion of the second sidewall being spaced from the first sidewall to define a space between the first sidewall and the second sidewall. The outsole is secured to the midsole, and the outsole defines a ridge that is positioned within a lower portion of the space and between the first sidewall and the second sidewall.

In another aspect of the invention the midsole defines a first aperture and a separate second aperture, and the midsole includes a first insert and a second insert. The first insert is positioned within the first aperture, and at least a portion of a sidewall of the first aperture is spaced from a sidewall of the first insert. The first insert has a shape of at least three connected rounded regions. The second insert is positioned within the second aperture, and at least a portion of a sidewall of the second aperture is spaced from a sidewall of the second insert. The second insert has a shape of at least two connected rounded regions. The outsole is secured to the midsole, and the outsole defines a first ridge and a second ridge. The first ridge is positioned between the sidewall of the first aperture and the sidewall of the first insert, and the second ridge is positioned between the sidewall of the second aperture and the sidewall of the second insert.

In yet another aspect of the invention the midsole is formed of a polymer foam material that defines an aperture. The midsole includes an insert that is positioned within the aperture, and the insert being spaced from a sidewall of the aperture. The insert may have a shape of at least two connected rounded regions. The outsole is secured to the midsole, and the outsole defines a ridge that is positioned between the sidewall of the aperture and the insert.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

The following discussion and accompanying figures disclose an article of footwear 10 in accordance with the present invention. Concepts related to article of footwear 10 are disclosed with reference to footwear having a configuration that is suitable for the sport of basketball. The invention is not solely limited to footwear designed for basketball, however, and may be applied to a wide range of athletic footwear styles that include running shoes, walking shoes, cross-training shoes, tennis shoes, soccer shoes, and football shoes, for example. In addition to athletic footwear, concepts related to the invention may be applied to non-athletic footwear (e.g., dress shoes and work boots) or footwear serving a medical or rehabilitative purpose. Accordingly, one skilled in the relevant art will appreciate that the concepts disclosed herein apply to a wide variety of footwear styles, in addition to the specific style discussed in the following material and depicted in the accompanying figures.

Figure 1:
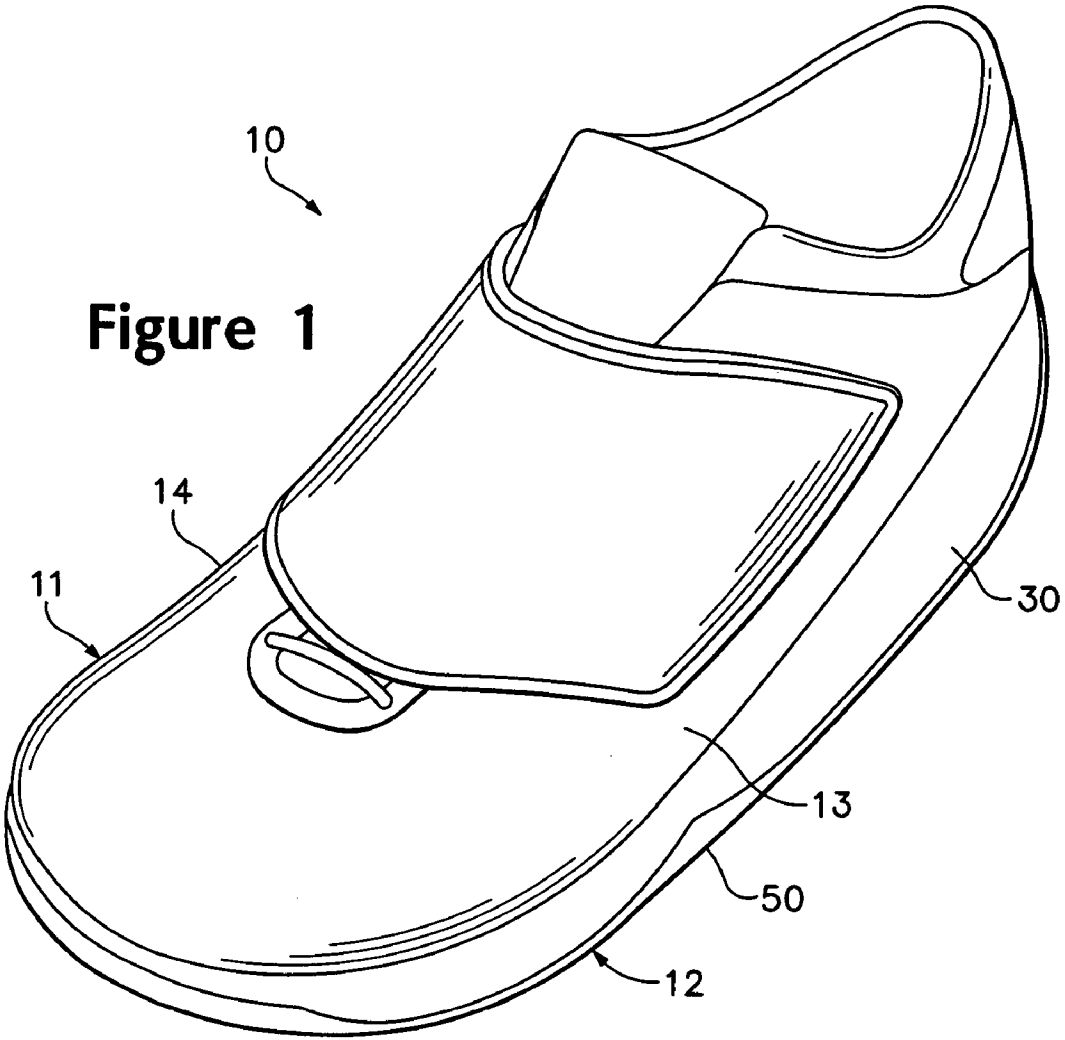
FIG. 1 is a perspective view of an article of footwear having a sole structure in accordance with the present invention.
Figure 2:
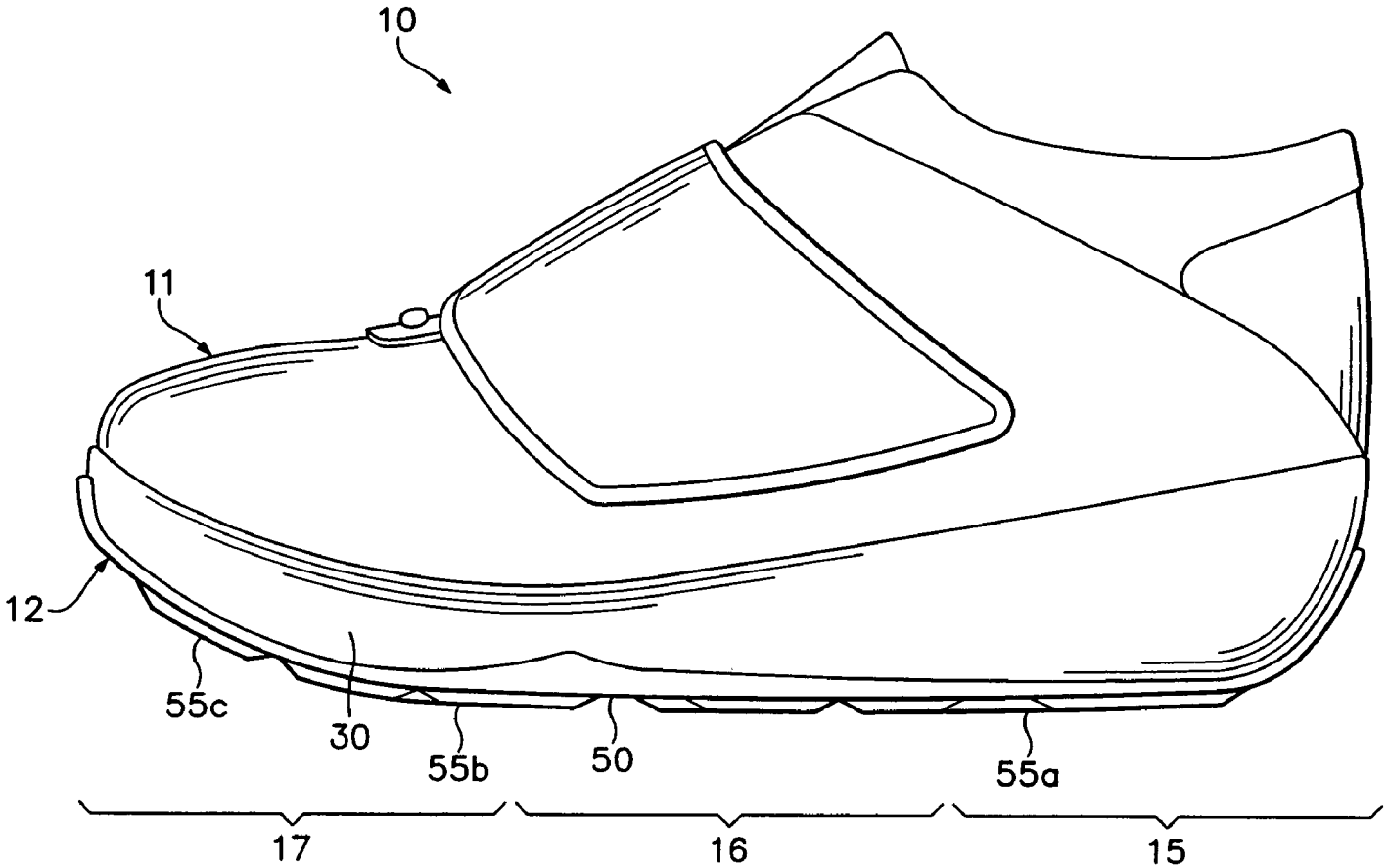
FIG. 2 is a side elevational view of the article of footwear.
Figure 3:
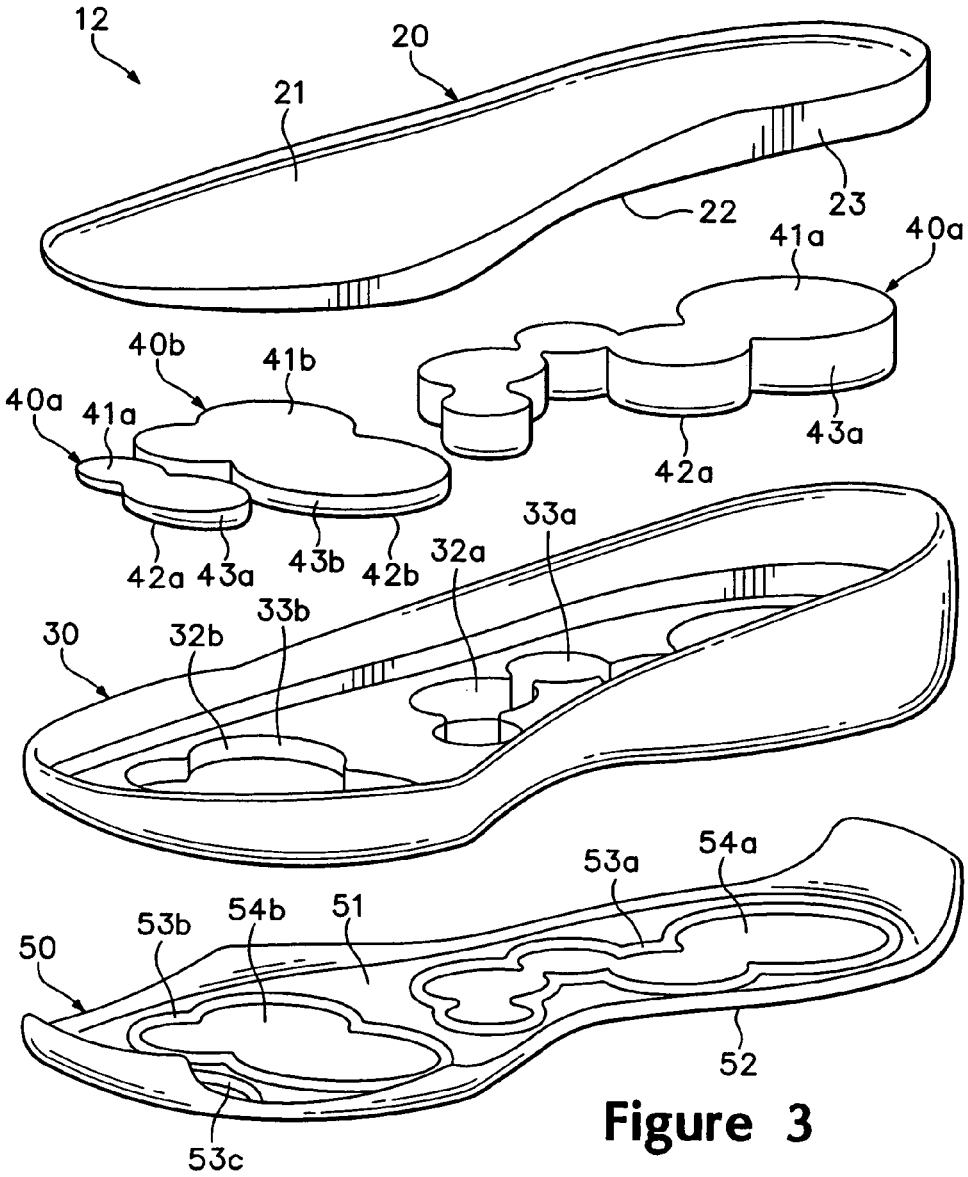
FIG. 3 is a first exploded perspective view of the sole structure.
Figure 4:
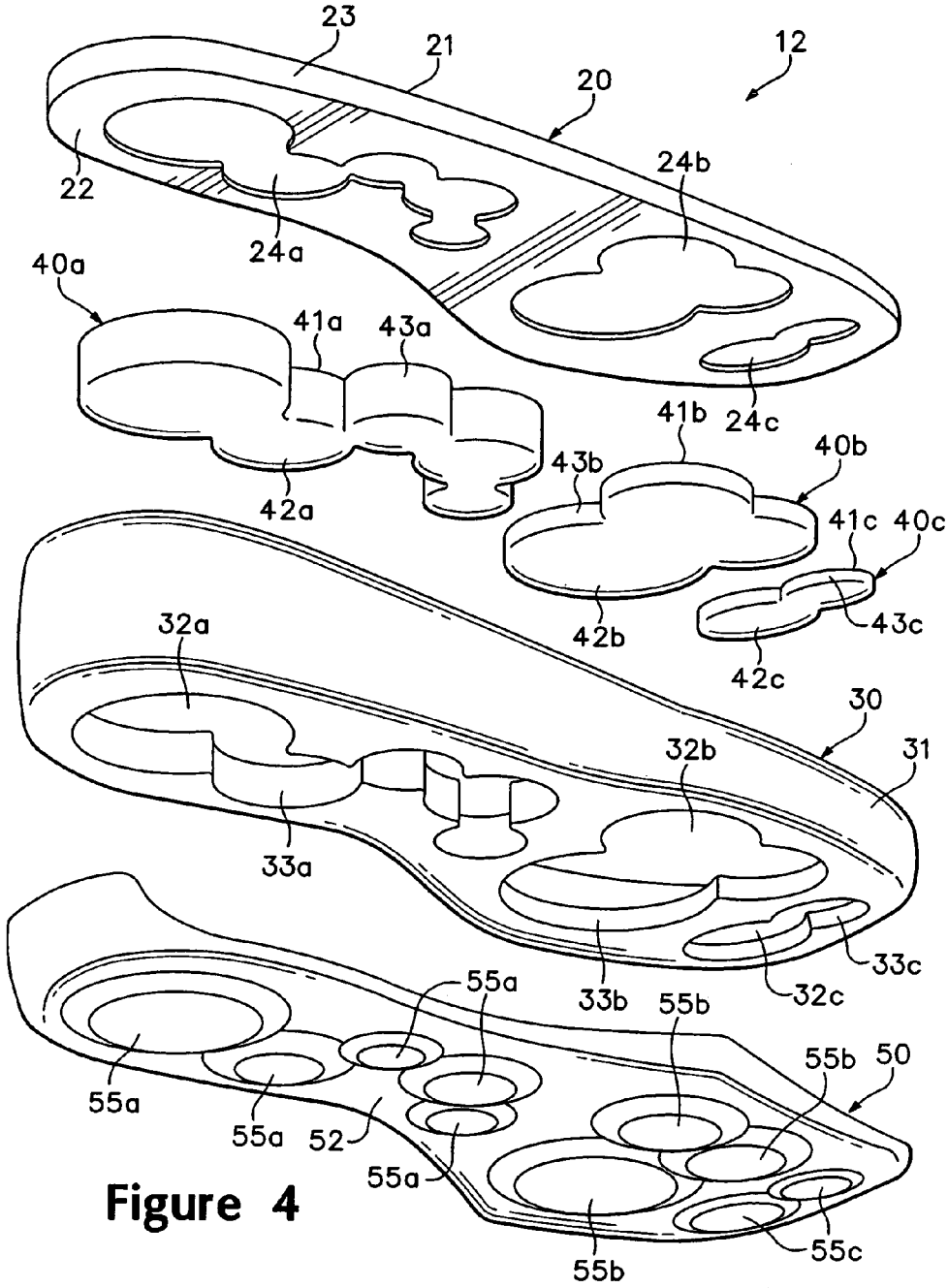
FIG. 4 is a second exploded perspective view of the sole structure.

Article of footwear 10 is depicted in FIGS. 1 and 2 as including an upper 11 and a sole structure 12. Upper 11 may incorporate a plurality material elements (e.g., textiles, foam, and leather) that are stitched or adhesively bonded together to form an interior void for securely and comfortably receiving a foot. The material elements may be selected and located with respect to upper 11 in order to selectively impart properties of durability, air-permeability, wear-resistance, flexibility, and comfort, for example. In addition, upper 11 may include a lace that is utilized in a conventional manner to modify the dimensions of the interior void, thereby securing the foot within the interior void and facilitating entry and removal of the foot from the interior void. The lace may extend through apertures in upper 11, and a tongue portion of upper 11 may extend between the interior void and the lace. Footwear 10 may also incorporate a lace cover that provides protection to the laces during athletic activities. Accordingly, upper 11 may have a substantially conventional configuration within the scope of the present invention.

Sole structure 12, as depicted in FIGS. 3–7, is secured to a lower area of upper 11. The primary elements of sole structure 12 include a cover member 20, a frame member 30, three inserts 40*a*–40*c*, and an outsole 50. Collectively, cover member 20, frame member 30, and inserts 40*a*–40*c* form a midsole portion of footwear 10 that may impart stability, attenuate ground reaction forces, and absorb shock, for example. Outsole 50 is secured to a lower surface of the midsole portion (i.e., frame member 30 and inserts 40*a*–40*c*) in order to impart wear-resistance and traction. For purposes of reference in the following discussion, sole structure 12 includes a lateral side 13, a medial side 14, a heel region 15, a midfoot region 16, and a forefoot region 17. Regions 15–17 are not intended to demarcate precise portions of footwear 10, but are intended to form areas of reference in the following discussion.

Cover member 20 forms an upper portion of sole structure 12 that extends through at least a portion of the longitudinal length of footwear 10 (i.e., through regions 15–17) and between lateral side 13 and medial side 14. The primary surfaces of cover member 20 include an upper surface 21, a lower surface 22, and a side surface 23. In addition, to surfaces 21–23, cover member 20 may include three indentations 24*a*–24*c* that are formed in lower surface 22 for receiving upper portions of the various inserts 40*a*–40*c*. Upper surface 21 is positioned adjacent to upper 20 and may be secured to upper 20 in a conventional manner (e.g., with an adhesive). In order to conform with a shape of the foot received by upper 11 and provide support for the foot, upper surface 21 may exhibit a contoured configuration. More particularly, the contours of upper surface 21 may include a depression in heel region 15 for supporting the heel, and the contours of upper surface 21 may include a raised area on medial side 14 and in midfoot region 16 for supporting an arch area of the foot.

Frame member 30 supports cover member 20 and also extends through at least a portion of the longitudinal length of footwear 10 and between lateral side 13 and medial side 14. Frame member 30 forms an exterior surface 31 and also defines three apertures 32*a*–32*c*. Exterior surface 31 is a generally vertical portion of frame member 30 that extends around frame member 30 and may also form the exterior surface of sole structure 12. Apertures 32*a*–32*c* respectively form sidewalls 33*a*–33*c* and extend entirely though frame member 30 to form areas for receiving the various inserts 40*a*–40*c*.

Inserts 40*a*–40*c* are positioned within apertures 32*a*–32*c* and extend between cover member 20 and outsole 50. Insert 40*a* includes an upper surface 41*a*, a lower surface 42*a*, and a sidewall 43*a*. Upper surface 41*a* extends into and may be joined or otherwise bonded with indentation 24*a* of cover member 20. Similarly, lower surface 42*a* contacts and may be joined with outsole 50, as described in greater detail below. Sidewall 43*a* extends along and is substantially parallel to sidewall 33*a* of frame member 30. Rather than contact sidewall 33*a*, however, a space 44*a* is formed between sidewall 33*a* and sidewall 43*a*. The distance across space 44*a* (i.e., the distance between sidewall 33*a* and sidewall 43*a*) is depicted as being substantially constant around insert 40*a*, but may vary in some embodiments of the invention. In some embodiments of the invention, sidewall 43*a* may contact sidewall 33*a*.

Inserts 40*b*–40*c* exhibit a configuration that is similar to insert 40*a*. Accordingly, inserts 40*b*–40*c* respectively include upper surfaces 41*b*–41*c*, lower surfaces 42*b*–42*c*, and sidewalls 43*b*–43*c*. As with insert 40*a*, upper surfaces 41*b*–41*c* respectively extend into and may be joined or otherwise bonded with indentations 24*b*–24*c*. Similarly, lower surfaces 42*b*–42*c* contact and may be joined with outsole 50. In addition, spaces 44*b*–44*c* are respectively formed between sidewalls 33*b*–33*c* and sidewalls 43*b*–43*c*.

The distance across spaces 44*b*–44*c* is also depicted as being substantially constant, but may vary in some embodiments of the invention.

The shapes of the various apertures 32*a*–32*c* respectively correspond with the shapes of the various inserts 40*a*–40*c*. In general, however, the dimensions of apertures 32*a*–32*c* are greater than the dimensions of inserts 40*a*–40*c*, thereby forming spaces 44*a*–44*c* between the respective components. Inserts 40*a*–40*c* have the shapes of overlapping or tangentially-connected rounded regions. More particularly, insert 40*a* has the shape of five overlapping or tangentially-connected circular regions, insert 40*b* has three circular regions, and insert 40*c* has two circular regions. In further embodiments of the invention, inserts 40*a*–40*c* may have a variety of other shapes and are not limited to overlapping configurations. In addition, the circular regions may be replaced with triangular, square, oval, hexagonal, or pentagonal regions for example, or other non-geometrically-shaped regions. Furthermore, the number of regions in each of inserts 40*a*–40*c* and the number of inserts may vary considerably. Accordingly, the specific configuration of the various inserts 40*a*–40*c* may vary significantly within the scope of the present invention.

Insert 40*a*, as discussed above, has the shape of five overlapping or tangentially-connected circular regions that are arranged to extend through heel region 15 and into midfoot region 16. A first of the circular regions of insert 40*a*, which is also the largest in diameter, is located within heel region 15 and is positioned to be equidistant from lateral side 13 and medial side 14. The first of the circular regions is, therefore, positioned to correspond with a location of a calcaneus bone of the foot and operates to provide support to the calcaneus bone. A second of the circular regions is closer to medial side 14 than lateral side 13. Similarly, a third of the circular regions is closer to lateral side 13 than medial side 14. A fourth and fifth of the circular regions are positioned in midfoot region 16 and correspond in location with an arch area of the foot.

The pattern for the various regions of insert 40*a* described above generally correspond with and complement the manner in which the foot rolls during the running motion. In general, the motion of the foot during running proceeds as follows: Initially, the heel strikes the ground, followed by the ball of the foot. As the heel leaves the ground, the foot rolls forward so that the toes make contact, and finally the entire foot leaves the ground to begin another cycle. During the time that the foot is in contact with the ground, the foot typically rolls from the outside (i.e., lateral side 13) to the inside (i.e., medial side 14), a process called pronation. That is, normally, the outside of the heel strikes first and the toes on the inside of the foot leave the ground last. Accordingly, the various regions of insert 40*a* are positioned at areas of relatively high foot pressure during the running cycle.

Insert 40*b* has the shape of three overlapping or tangentially-connected circular regions that are arranged in a triangular pattern. The position of insert 40*b* generally corresponds with the transition area between midfoot region 16 and forefoot region 17. Insert 40*b* is located, therefore, to correspond with the position of the joints between the metatarsals and the proximal phalanges of the foot. One of the circular regions of insert 40*b* has a greater diameter than the remaining circular regions and is positioned to correspond in location with the joint between the first metatarsal and the first proximal phalanx. Insert 40*c* has the shape of two overlapping or tangentially-connected circular regions that are arranged linearly. Insert 40*c* is positioned within forefoot region 17 and corresponds in location with forward areas of the foot (e.g., the distal phalanges of the second through fourth digits).

The thickness of sole structure 12 decreases between heel region 15 and forefoot region 17. Insert 40*a* is positioned in heel region 15 and exhibits a greater thickness than either of inserts 40*b* and 40*c*. Similarly, insert 40*b* is positioned in midfoot region 16 and exhibits a greater thickness than insert 40*c*. The various thicknesses of inserts 40*a*–40*c* may be selected, therefore, to conform with the general decrease in thickness of sole structure 12 between heel region 15 and forefoot region 17.

Cover member 20, frame member 30, and inserts 40*a*–40*c* are depicted in the figures as being separate elements of sole structure 12. In some embodiments of the invention, however, cover member 20 and frame member 30 may be formed of unitary (i.e., one piece) construction. Cover member 20 and one or more of inserts 40*a*–40*c* may also be formed of unitary construction. Suitable materials for cover member 20, frame member 30, and inserts 40*a*–40*c* include any of the materials conventionally utilized in footwear midsoles, including polyurethane and ethylvinylacetate foam, for example. The density of the foams that are utilized for cover member 20, frame member 30, and inserts 40*a*–40*c* may also vary. For example, cover member 20 and frame member 30 may be formed of a foam with a greater density than the foam forming inserts 40*a*–40*c*. Each of inserts 40*a*–40*c* may be formed from foams with different densities, and each of the regions of inserts 40*a*–40*c* may be formed to exhibit different foam densities. For example, the regions positioned adjacent to lateral side 13 may have a greater density than the regions positioned adjacent to medial side 14, thereby operating to limit pronation of the foot during running. In addition to polymer foams, inserts 40*a*–40*c* may be formed from various fluid-filled bladders, as disclosed in U.S. Pat. No. 4,183,156 to Rudy, for example.

Outsole 50 is positioned to form a ground-engaging surface of footwear 10 and extends under cover member 20, frame member 30, and inserts 40*a*–40*c*. Outsole 50 includes an upper surface 51 and an opposite lower surface 52. Upper surface 51 defines three ridges 53*a*–53*c* that respectively correspond in shape to inserts 40*a*–40*c*, and ridges 53*a*–53*c* respectively define three depressions 54*a*–54*c* in outsole 50. Insert 40*a* extends into depression 54*a* such that ridge 53*a* extends around a lower area of insert 40*a*. Ridge 53*a* is positioned between sidewall 33*a* and sidewall 43*a*. Ridge 53*a* is therefore, positioned within a lower area of space 44*a*. Similarly, insert 40*b*–40*c* respectively extend into depressions 54*b*–54*c* such that ridges 53*b*–53*c* extend around lower areas of inserts 40*b*–40*c*. Ridges 53*b*–53*c* are also respectively positioned between sidewalls 33*b*–33*c* and sidewalls 43*b*–43*c*. Ridges 53*b*–53*c* are, therefore, positioned within lower areas of spaces 44*b*–44*c*. Outsole 50 also includes various protrusions 55*a*–55*c* that extend outward from lower surface 52. Protrusions 55*a*–55*c* correspond in location with depressions 54*a*–54*c*. Three grooves 56*a*–56*c* also extend around each of protrusions 55*a*–55*c* and correspond in location with ridges 53*a*–53*c*. Grooves 56*a*–56*c* extend, therefore, into ridges 53*a*–53*c*, as depicted in the cross-sections of FIGS. 5A–6B. Suitable materials for outsole 50 include any of the conventional materials utilized for footwear outsoles, such as carbon black rubber compound. Inserts 40*a*–40*c* are adhesively bonded to outsole 50, but may remain unbonded in some embodiments of the invention.

Figure 5A:
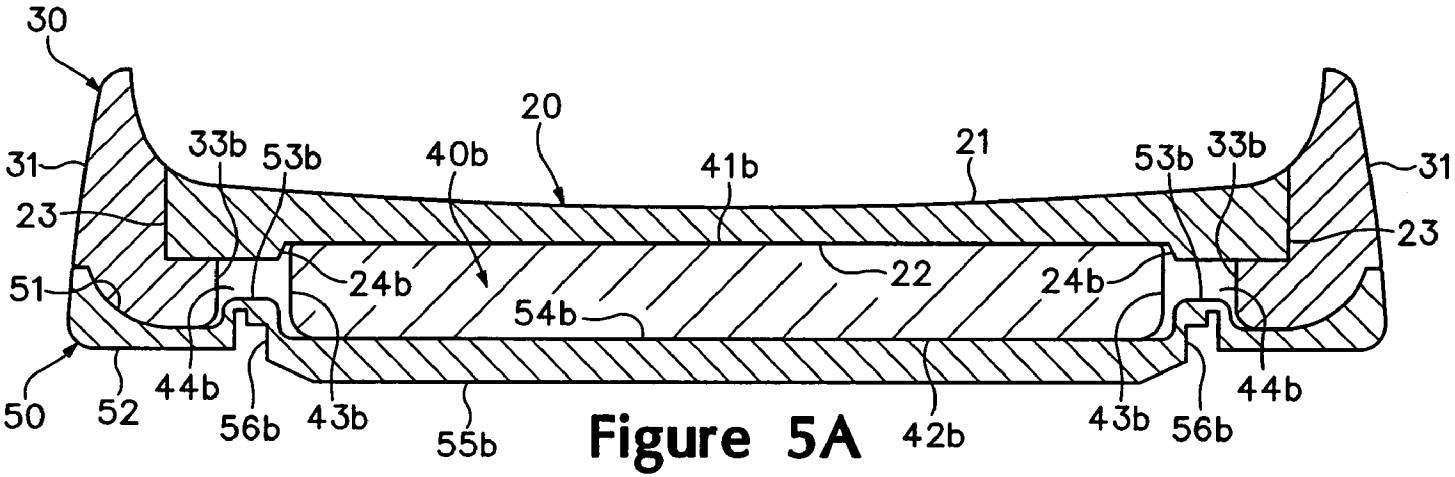
FIG. 5A is a cross-sectional view of the sole structure in an uncompressed configuration, as defined along section line 5—5 in FIG. 7.
Figure 5B:
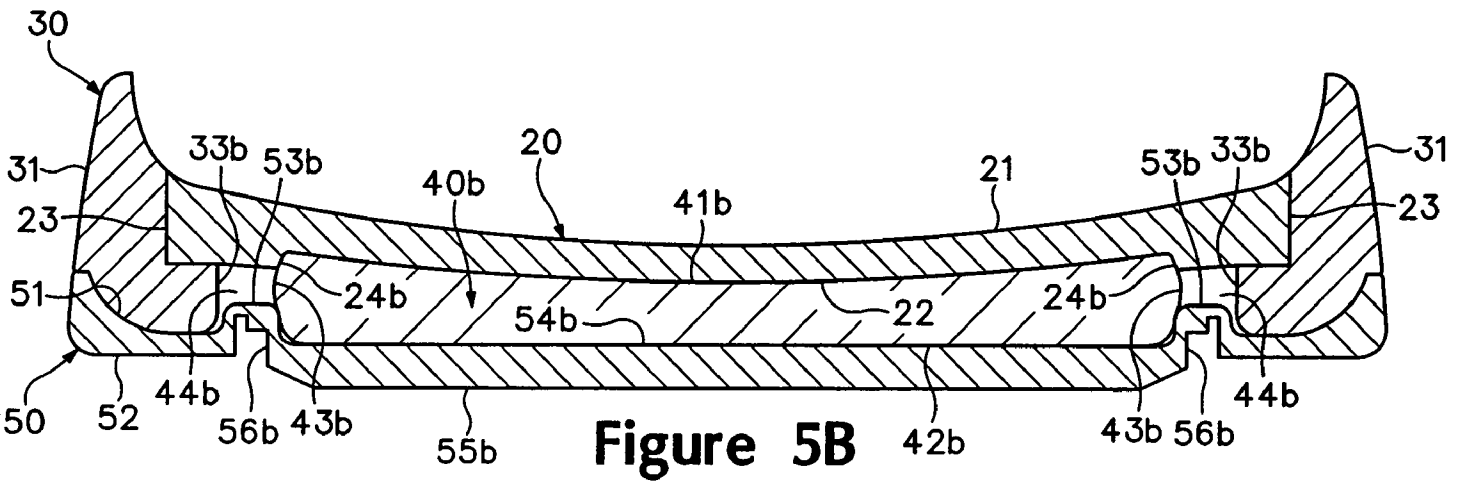
FIG. 5B is a cross-sectional view of the sole structure in a compressed configuration, as defined along section line 5—5 in FIG. 7.
Figure 6A:
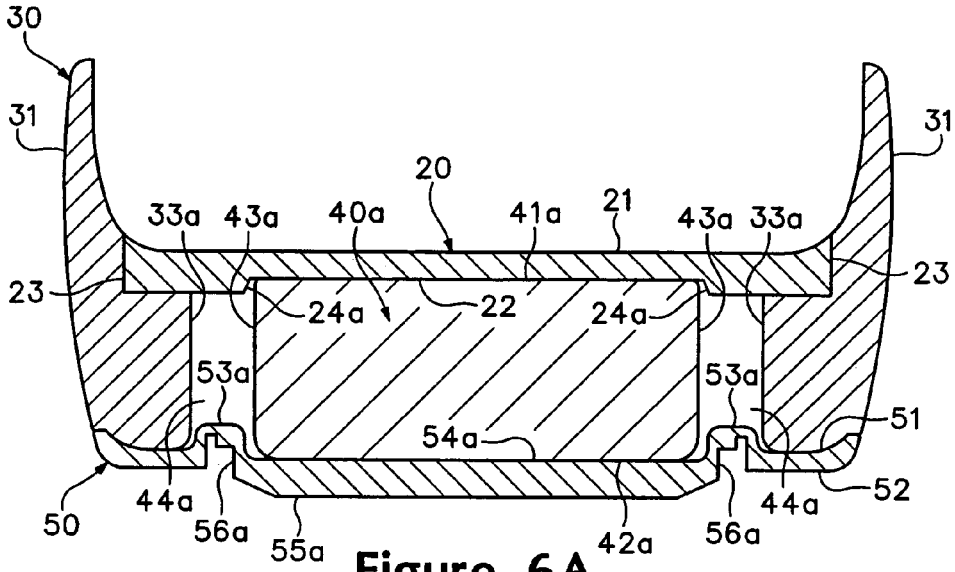
FIG. 6A is a cross-sectional view of the sole structure in an uncompressed configuration, as defined along section line 6—6 in FIG. 7.
Figure 6B:
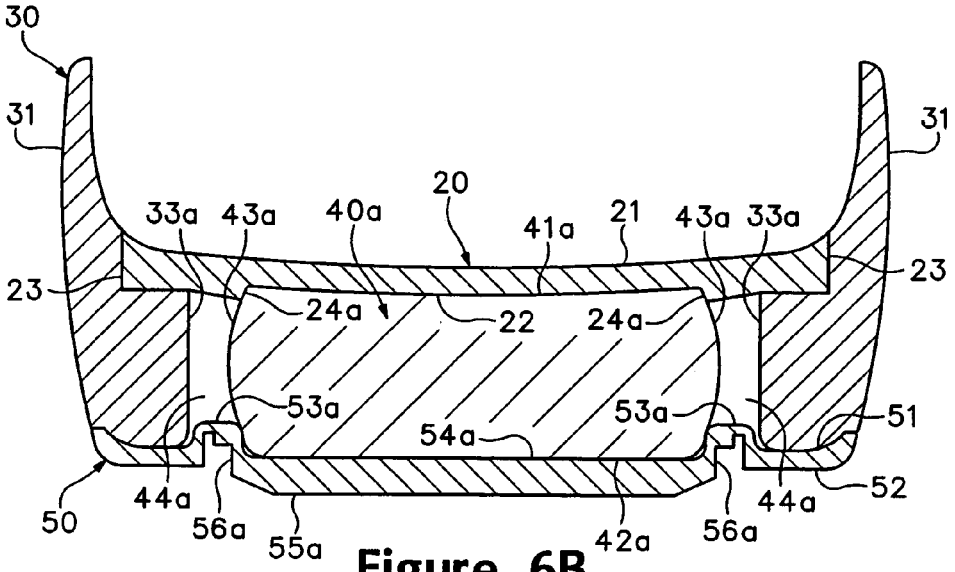
FIG. 6B is a cross-sectional view of the sole structure in a compressed configuration, as defined along section line 6—6 in FIG. 7.
Figure 7:
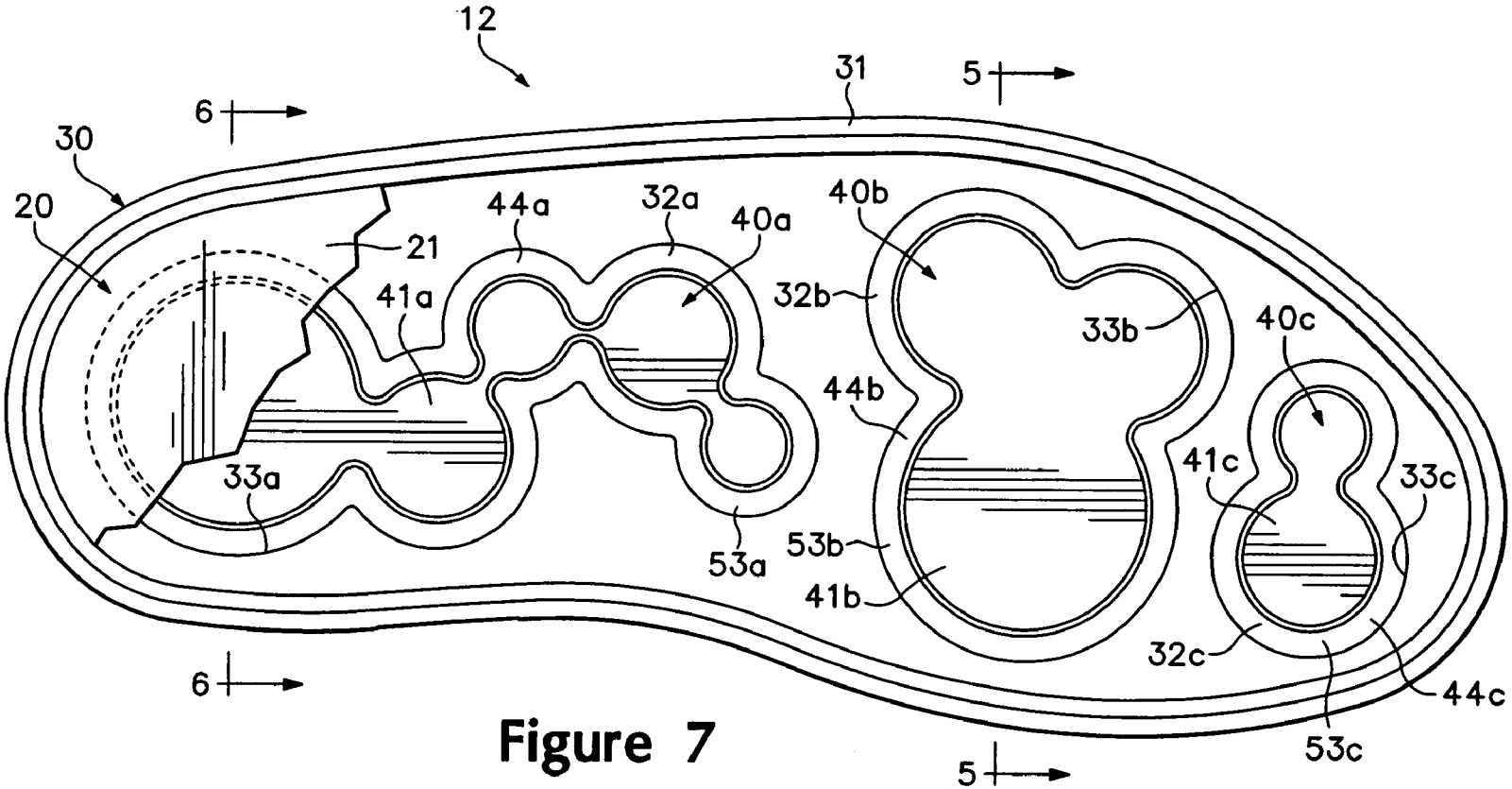
FIG. 7 is a top plan view of a portion of the sole structure.

The operation of sole structure 12 will now be discussed. During ambulatory motions, such as walking and running, sole structure 12 is compressed between the foot and the ground. Protrusions 55*a*–55*c* extend below the level of other portions of sole structure 12 and initially contact the ground during the ambulatory activities. The configuration of ridges 53*a*–53*c* and grooves 56*a*–56*c* permit outsole 50 to displace vertically and operate, therefore, in a manner that is analogous to a speaker diaphragm. Inserts 40*a*–40*c* are bonded between cover member 20 and outsole 50, but are free from any bonding or other restrictions along sidewalls 33*a*–33*c*. This configuration allows for the independent vertical displacement of inserts 40*a*–40*c* with respect to each other and with respect to frame member 30. That is, the configuration of inserts 40*a*–40*c* provides zones of independent compressibility in sole structure 12. Referring to FIGS. 5A and 6A, sole structure 12 is depicted in an uncompressed configuration. In FIGS. 5B and 6B, however, inserts 40*a*–40*b* are depicted as being compressed, and inserts 40*a* and 40*b* bow outward into spaces 44*a*–44*b*. The various inserts 40*a*–40*c* may, therefore, deflect independently.

The configuration of sole structure 12 discussed above provides variability in the properties of footwear 10. As discussed above, each of the regions of inserts 40*a*–40*c* may be formed to exhibit different foam densities. For example, the regions positioned adjacent to lateral side 13 may have a greater density than the regions positioned adjacent to medial side 14, thereby operating to limit pronation of the foot during running. As a further alternative, each of inserts 40*a*–40*c* may be formed from polymer foams with different densities. Some individuals may prefer, for example, that insert 40*a* be formed from a polymer foam that is more dense than the polymer foam of inserts 40*b* and 40*c*. When custom-manufacturing footwear 10, therefore, sole structure 12 may be tuned to the preferences of particular individuals by merely modifying the properties of inserts 40*a*–40*c*. Differences in the properties of inserts 40*a*–40*c* may also be utilized to configure footwear 10 for different activities. For example, one configuration of polymer foam densities may be suitable for basketball, whereas another configuration of polymer foam densities may be suitable for running. Two different articles of footwear may be made, therefore, with substantially similar soles, except for the materials selected for inserts 40*a*–40*c*. Accordingly, the configuration disclosed with respect to sole structure 12 provides significant design latitude for tailoring footwear 10 to a particular individual or a particular athletic activity.

Figure 8:
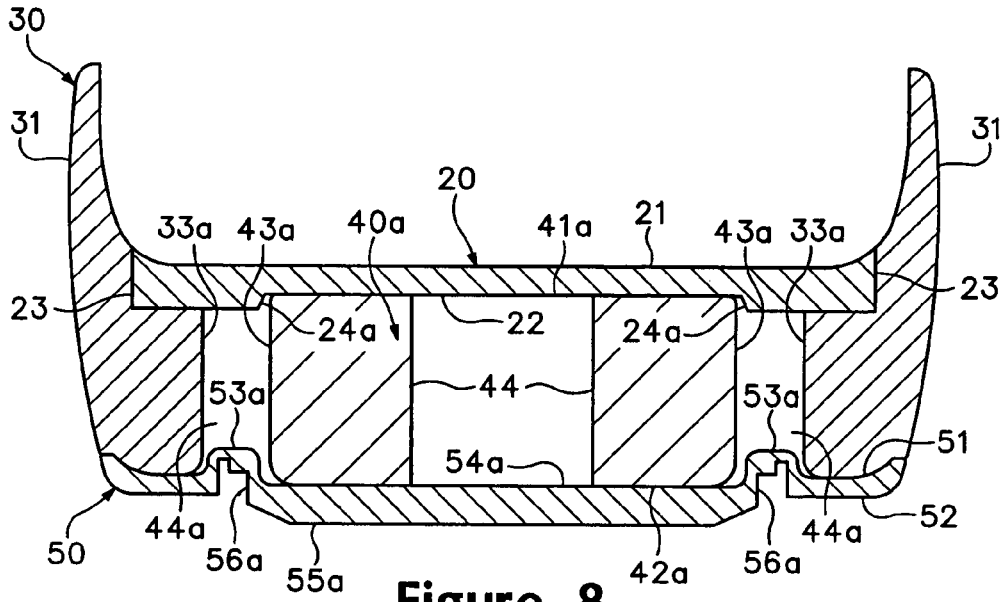
FIG. 8 is a cross-sectional view of the sole structure according to another embodiment of the invention, the cross-sectional view corresponding with FIG. 6A.
Figure 9:
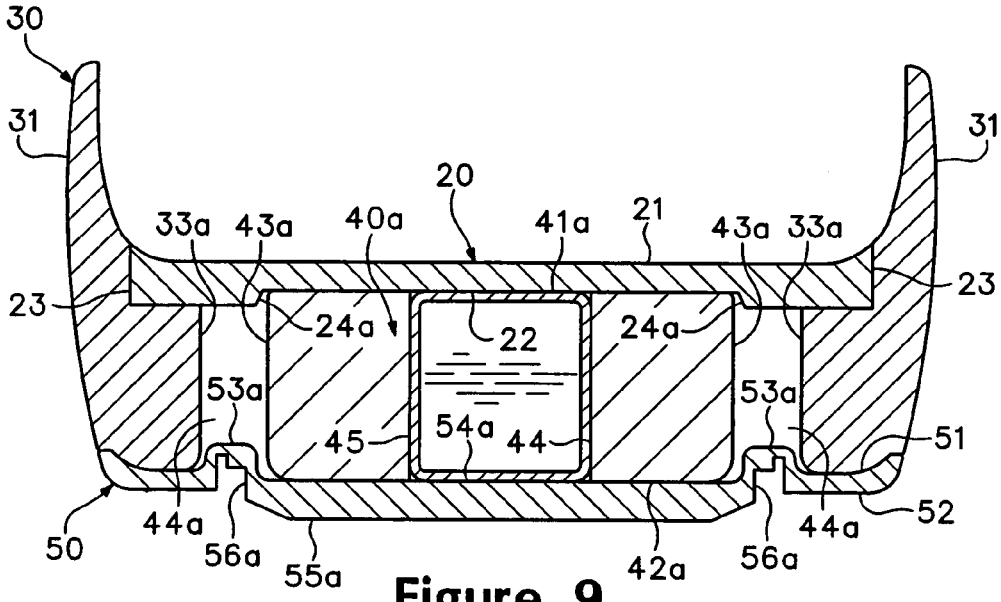
FIG. 9 is a cross-sectional view of the sole structure according to yet another embodiment of the invention, the cross-sectional view corresponding with FIG. 6A.

With reference to FIG. 8, another embodiment of the invention is depicted, wherein an aperture 44 extends through insert 40*a*. As depicted, aperture 44 extends entirely through insert 40*a*, but may also extend only partially through insert 40*a*. When insert 40*a* is compressed, the sidewall of aperture 44 will deform in a manner that is analogous to sidewall 43*a*, for example. The manner in which insert 40*a* compresses during ambulatory motions is at least partially dependent upon the dimensions of aperture 44. Accordingly, aperture 44*a* may have a variety of dimensions and shapes within the scope of the present invention. Referring to FIG. 9, yet another embodiment of the invention is depicted, wherein a fluid-filled bladder 45 is located within aperture 44. Bladder 45 may have a configuration that corresponds with any of the conventional fluid-filled bladders discussed above in the Background of the Invention section. Although aperture 44 and bladder 45 are discussed above in relation to insert 40*a*, similar structures may be incorporated into any of inserts 40*a*–40*c*.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of footwear incorporating an upper and a sole structure secured to the upper, the sole structure comprising:

a midsole extending along at least a portion of a longitudinal length of the footwear, the midsole defining an aperture with a first sidewall, the midsole including an insert positioned within the aperture, the insert having a second sidewall, at least a portion of the second sidewall being spaced from the first sidewall to define a space between the first sidewall and the second sidewall; and an outsole secured to the midsole, the outsole defining a ridge that is positioned within a lower portion of the space and between the first sidewall and the second sidewall.

2. The article of footwear recited in claim 1, wherein a shape of the insert corresponds with a shape of the aperture.

3. The article of footwear recited in claim 2, wherein the shape of the insert includes at least two overlapping rounded regions.

4. The article of footwear recited in claim 2, wherein the shape of the insert includes at least two circular regions.

5. The article of footwear recited in claim 1, wherein a distance between the first sidewall and the second sidewall is substantially constant around the insert.

6. The article of footwear recited in claim 1, wherein the midsole includes a frame member and a cover member, the frame member defining the aperture and the cover member extending over the aperture and the insert.

7. The article of footwear recited in claim 6, wherein the cover member is secured to the upper.

8. The article of footwear recited in claim 6, wherein a lower surface of the cover member includes an indentation for receiving an upper surface of the insert.

9. The article of footwear recited in claim 1, wherein the first sidewall and the second sidewall exhibit a substantially vertical orientation.

10. The article of footwear recited in claim 1, wherein the outsole defines a depression for receiving the insert.

11. The article of footwear recited in claim 10, wherein the ridge extends around the depression.

12. The article of footwear recited in claim 10, wherein a lower surface of the outsole protrudes outward below the depression.

13. The article of footwear recited in claim 1, wherein a distance across the space decreases when the sole structure is compressed.

14. The article of footwear recited in claim 1, wherein compressing the sole structure increases a diameter of the insert and decreases a distance across the space.

15. The article of footwear recited in claim 1, wherein the midsole element defines at least one additional aperture that is separate from the aperture, and the footwear includes an additional insert that is separate from the insert, the additional aperture receiving the additional insert.

16. The article of footwear recited in claim 1, wherein the outsole defines a protrusion located opposite the ridge, the protrusion extending under the insert.

17. The article of footwear recited in claim 16, wherein the protrusion exhibits a shape that corresponds with a shape of the insert.

18. The article of footwear recited in claim 1, wherein an insert aperture extends at least partially through the insert.

19. The article of footwear recited in claim 18, wherein a fluid-filled bladder is positioned within the insert aperture.

20. An article of footwear incorporating an upper and a sole structure secured to the upper, the sole structure comprising:

a frame member extending along at least a portion of a longitudinal length of the footwear, the frame member defining an aperture with a first sidewall;

an insert positioned within the aperture, the insert including an upper surface, a lower surface, and a second sidewall extending between the upper surface and the lower surface, at least a portion of the second sidewall being spaced from the first sidewall to define a space between the first sidewall and the second sidewall;

a cover member extending over the aperture, a lower surface of the cover member defining an indentation that receives the upper surface of the insert; and an outsole extending under the aperture, the outsole defining a ridge that is positioned within a lower portion of the space and between the first sidewall and the second sidewall, and the outsole defining a depression for receiving the lower surface of the insert, the ridge extending at least partially around the depression.

21. The article of footwear recited in claim 20, wherein a distance between the first sidewall and the second sidewall is substantially constant around the insert.

22. The article of footwear recited in claim 20, wherein the midsole element and the insert are formed from polymer foam materials, and a distance across the space decreases when the sole structure is compressed.

23. The article of footwear recited in claim 20, wherein compressing the sole structure increases a diameter of the insert and decreases a distance across the space.

24. The article of footwear recited in claim 20, wherein the cover member is secured to the upper.

25. The article of footwear recited in claim 20, wherein the first sidewall and the second sidewall exhibit a substantially vertical orientation.

26. The article of footwear recited in claim 20, wherein the frame member defines at least one additional aperture that is separate from the aperture, and the footwear includes an additional insert that is separate from the insert, the additional aperture receiving the additional insert.

27. The article of footwear recited in claim 20, wherein the outsole defines a protrusion located opposite the ridge, the protrusion extending under the insert.

28. The article of footwear recited in claim 27, wherein the protrusion exhibits a shape that corresponds with a shape of the insert.

29. The article of footwear recited in claim 20, wherein a shape of the insert corresponds with a shape of the aperture.

30. The article of footwear recited in claim 29, wherein the shape of the insert includes at least two overlapping rounded regions.

31. The article of footwear recited in claim 29, wherein the shape of the insert includes at least two overlapping circular regions.

32. The article of footwear recited in claim 20, wherein an insert aperture extends at least partially through the insert.

33. The article of footwear recited in claim 32, wherein a fluid-filled bladder is positioned within the insert aperture.

34. An article of footwear incorporating an upper and a sole structure secured to the upper, the sole structure comprising:

a midsole extending along at least a portion of a longitudinal length of the footwear and having a lateral side and a medial side, the midsole defining a first aperture and a separate second aperture, and the midsole including:

a first insert positioned within the first aperture, at least a portion of a sidewall of the first aperture being spaced from a sidewall of the first insert, the first insert having a shape of at least three connected rounded regions; and a second insert positioned within the second aperture, at least a portion of a sidewall of the second aperture being spaced from a sidewall of the second insert, the second insert having a shape of at least two connected rounded regions; and an outsole secured to the midsole, the outsole defining a first ridge and a second ridge, the first ridge being positioned between the sidewall of the first aperture and the sidewall of the first insert, and the second ridge being positioned between the sidewall of the second aperture and the sidewall of the second insert.

35. The article of footwear recited in claim 34, wherein a distance between the first sidewall of the first insert and the sidewall of the first aperture is substantially constant around the first insert.

36. The article of footwear recited in claim 34, wherein the midsole includes a frame member and a cover member, the frame member defining the first aperture and the second aperture, and the cover member extending over the first aperture and the second aperture.

37. The article of footwear recited in claim 36, wherein a lower surface of the cover member includes a first indentation for receiving an upper surface of the first insert, and the cover member includes a second indentation for receiving an upper surface of the second insert.

38. The article of footwear recited in claim 36, wherein the frame member, the first insert, and the second insert are formed from polymer foam materials.

39. The article of footwear recited in claim 34, wherein a distance between the sidewall of the first aperture and the sidewall of the first insert decreases when the sole structure is compressed.

40. The article of footwear recited in claim 39, wherein a distance between the sidewall of the second aperture and the sidewall of the second insert decreases when the sole structure is compressed.

41. The article of footwear recited in claim 34, wherein the outsole defines a first depression for receiving the first insert, and the outsole defines a second depression for receiving the second insert.

42. The article of footwear recited in claim 34, wherein a lower surface of the outsole includes a first protrusion and a second protrusion, the first protrusion having the shape of the first insert, and the second protrusion having the shape of the second insert.

43. The article of footwear recited in claim 34, wherein the first insert is positioned in a heel region of the footwear and exhibits a first thickness, and the second insert is positioned forward of the first insert and exhibits a second thickness, the first thickness being greater than the second thickness.

44. The article of footwear recited in claim 34, wherein an insert aperture extends at least partially through at least one of the first insert and the second insert.

45. The article of footwear recited in claim 44, wherein a fluid-filled bladder is positioned within the insert aperture.

46. An article of footwear incorporating an upper and a sole structure secured to the upper, the sole structure comprising:

a midsole extending along at least a portion of a longitudinal length of the footwear and having a lateral side and a medial side, the midsole defining a first aperture and a separate second aperture, and the midsole including:

a first insert positioned within the first aperture, the first insert having a shape of at least three connected rounded regions, a center of a first of the rounded regions being substantially equidistant from the lateral side and the medial side, a center of a second of the rounded regions being positioned closer the lateral side than the medial side, and a center of a third of the rounded regions being positioned closer the medial side than the lateral side, and a second insert positioned within the second aperture, the second insert having a shape of at least two connected rounded regions that are positioned in a medial-to-lateral direction with respect to each other; and an outsole secured to the midsole.

47. The article of footwear recited in claim 46, wherein at least a portion of a sidewall of the first aperture is spaced from a sidewall of the first insert.

48. The article of footwear recited in claim 47, wherein at least a portion of a sidewall of the second aperture is spaced from a sidewall of the second insert.

49. The article of footwear recited in claim 46, wherein the outsole defines a first ridge and a second ridge, the first ridge being positioned between the first aperture and the first insert, and the second ridge being positioned between the second aperture and the second insert.

50. The article of footwear recited in claim 46, wherein a distance between the first insert and a sidewall of the first aperture is substantially constant around the first insert.

51. The article of footwear recited in claim 46, wherein the midsole includes a frame member and a cover member, the frame member defining the first aperture and the second aperture, and the cover member extending over the first aperture and the second aperture.

52. The article of footwear recited in claim 51, wherein a lower surface of the cover member includes a first indentation for receiving an upper surface of the first insert, and the cover member includes a second indentation for receiving an upper surface of the second insert.

53. The article of footwear recited in claim 46, wherein a lower surface of the outsole includes a first protrusion and a second protrusion, the first protrusion having the shape of the first insert, and the second protrusion having the shape of the second insert.

54. The article of footwear recited in claim 46, wherein the first insert is positioned in a heel region of the footwear and exhibits a first thickness, and the second insert is positioned forward of the first insert and exhibits a second thickness, the first thickness being greater than the second thickness.

55. The article of footwear recited in claim 46, wherein the midsole includes a third insert positioned within a third aperture, the third insert having a shape of at least two connected rounded regions that are positioned in the medial-to-lateral direction with respect to each other.

56. An article of footwear incorporating an upper and a sole structure secured to the upper, the sole structure comprising:

a midsole formed of a polymer foam material that defines an aperture, the midsole including an insert that is positioned within the aperture, the insert being spaced from a sidewall of the aperture, and the insert having a shape of at least two connected rounded regions; and an outsole secured to the midsole, the outsole defining a ridge that is positioned between the sidewall of the aperture and the insert.

57. The article of footwear recited in claim 56, wherein the rounded regions are circular.

58. The article of footwear recited in claim 56, wherein a distance between the sidewall of the aperture and the insert is substantially constant around the insert.

59. The article of footwear recited in claim 56, wherein the outsole defines a depression for receiving the insert.

60. The article of footwear recited in claim 59, wherein the ridge extends around the depression.

61. The article of footwear recited in claim 59, wherein a lower surface of the outsole protrudes outward below the depression.

62. The article of footwear recited in claim 56, wherein the outsole defines a protrusion located opposite the ridge, the protrusion extending under the insert.

63. The article of footwear recited in claim 62, wherein the protrusion exhibits a shape that corresponds with the shape of the insert.

* * * * *